US010189280B2

(12) United States Patent
Mark

(10) Patent No.: US 10,189,280 B2
(45) Date of Patent: Jan. 29, 2019

(54) CORRUGATED-BOARD MACHINE

(71) Applicant: BHS Corrugated Maschinen-und Anlagenbau GmbH, Weiherhammer (DE)

(72) Inventor: Maximilian Mark, Tirschenreuth (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 0 days.

(21) Appl. No.: 15/273,046

(22) Filed: Sep. 22, 2016

(65) Prior Publication Data

US 2017/0087879 A1 Mar. 30, 2017

(30) Foreign Application Priority Data

Sep. 24, 2015 (DE) ..... 10 2015 218 325

(51) Int. Cl.

| | |
|---|---|
| ***B41J 11/00*** | (2006.01) |
| ***B31F 1/28*** | (2006.01) |
| ***B41J 2/01*** | (2006.01) |
| ***B41F 23/08*** | (2006.01) |

(52) U.S. Cl.

CPC ..... *B41J 11/0015* (2013.01); *B31F 1/285* (2013.01); *B31F 1/2822* (2013.01); *B41F 23/08* (2013.01); *B41J 2/01* (2013.01); *B41J 11/002* (2013.01)

(58) Field of Classification Search

CPC ..... B41J 2/2114; B41J 2202/21; B41J 11/68; B41J 11/70; B31F 1/2822; B31F 1/2813; B31F 1/285; Y10T 156/1025

See application file for complete search history.

(56) References Cited

U.S. PATENT DOCUMENTS

| | | | | |
|---|---|---|---|---|
| 4,882,005 | A * | 11/1989 | Thompson | B05C 1/0808 156/470 |
| 5,772,819 | A | 6/1998 | Olvey | |
| 6,170,881 | B1 * | 1/2001 | Salmon | B41M 3/06 283/91 |
| 2004/0182503 | A1 | 9/2004 | Stadele et al. | |
| 2009/0237425 | A1 * | 9/2009 | Lang | B41J 2/211 347/7 |
| 2009/0262159 | A1 * | 10/2009 | Lang | B41J 2/0057 347/15 |
| 2010/0086746 | A1 | 4/2010 | Kersnick et al. | |
| 2010/0194838 | A1 * | 8/2010 | Mitsuzawa | B41J 2/2114 347/102 |

(Continued)

FOREIGN PATENT DOCUMENTS

| | | |
|---|---|---|
| DE | 689 23 485 T2 | 2/1996 |
| EP | 0343794 B1 | 7/1995 |

(Continued)

*Primary Examiner* — John P Zimmermann

(74) *Attorney, Agent, or Firm* — McGlew and Tuttle, P.C.

(57) ABSTRACT

The invention relates to a corrugated-board machine for manufacturing corrugated board. The corrugated-board machine comprises a material-web output device for outputting a material web, an inkjet printing device disposed downstream of the material-web output device for the imprinting of at least one imprint onto the material web and an overcoating arrangement disposed downstream of the inkjet printing device for overcoating the printed material web at least in regions.

18 Claims, 3 Drawing Sheets

(56) References Cited

U.S. PATENT DOCUMENTS

| | | | | |
|---|---|---|---|---|
| 2011/0222126 | A1* | 9/2011 | Asai | B41J 2/2114 358/3.06 |
| 2012/0139984 | A1 | 6/2012 | Lang | |
| 2013/0029825 | A1 | 1/2013 | Rich | |
| 2014/0285558 | A1 | 9/2014 | Wada et al. | |
| 2017/0087793 | A1* | 3/2017 | Mark | B31F 1/2822 |
| 2017/0087900 | A1* | 3/2017 | Mark | B41J 15/04 |

FOREIGN PATENT DOCUMENTS

| | | | |
|---|---|---|---|
| GB | 2 493 208 | A | 1/2013 |
| JP | 2006-62243 | A | 3/2006 |
| JP | 2011-161659 | A | 8/2011 |
| WO | 2014/128115 | A1 | 8/2014 |

* cited by examiner

CORRUGATED-BOARD MACHINE

CROSS-REFERENCE TO RELATED APPLICATIONS

This application claims the priority of German Patent Application Serial No. DE 10 2015 218 325.4 filed on Sep. 24, 2015, pursuant to 35 U.S.C. (a)-(d), the content of which is incorporated herein by reference in its entirety as if fully set forth herein.

FIELD OF THE INVENTION

The invention relates to a corrugated-board machine and a method for manufacturing corrugated board.

BACKGROUND OF THE INVENTION

Printed corrugated-board webs and corrugated-board machines for manufacturing them are known generally from the prior art through prior public use.

Water-based inkjet imprints generally have the disadvantage that they are matt, which is attributable to their diffuse light reflection. In this sense, dependent upon layer thickness and substrate, matt varnishes exhibit highlight values between 10 to 50 with a 60° measurement geometry in accordance with ASTM D 523. Even with pre-treatment of such corrugated-board webs comprising imprints, it is hardly possible to give the latter a visually attractive gloss. Water-based inkjet imprints are also associated with the disadvantage that they are not abrasion resistant, which can lead to damage to the inkjet imprint, for example, during manufacturing the corrugated-board web.

By contrast, standard dispersion varnishes have the disadvantage that they can only be overprinted with difficulty and paste/glue adheres to them only poorly. This can lead to problems with necessary retrospective codings in packaging lines with regard to printability and in folding- or respectively in gluing machines in the further corrugated-board processing with regard to bondability.

SUMMARY OF THE INVENTION

The invention is based upon the object of providing a corrugated-board machine which overcomes the disadvantages specified above. In particular, a corrugated-board machine is to be provided, which allows an extremely economical corrugated-board manufacture and is capable of producing visually particularly attractive corrugated board. In particular, the corrugated board manufactured should also be very readily suitable for further processing and have a high gloss finish. A corresponding method for manufacturing corrugated board should also be provided.

This object is achieved according to the invention by a corrugated-board machine for manufacturing corrugated board, comprising a material-web output device for outputting a material web, an inkjet printing device disposed downstream of the material-web output device for printing at least one imprint on the material web, and an overcoating arrangement, disposed downstream of the inkjet printing device, for overcoating the printed material web at least in regions. Furthermore, this object is achieved according to the invention by a method for manufacturing corrugated board, comprising the following steps: output of a material web by means of a material-web output device, imprinting of at least one imprint onto the material web output by the material-web output device by means of an inkjet printing device, and overcoating the printed material web at least in regions by means of an overcoating arrangement. The core of the invention is that the material web is printed by means of an inkjet printing device, and the printed material web or respectively the at least one imprint produced is overcoated at least in regions. Through the overcoating, the at least one imprint or respectively the printed image is particularly well protected. Damage from subsequent processing can therefore be substantially excluded.

Such a material web or respectively corrugated-board is visually extremely attractive. For example, particularly good contrasts, especially matt-gloss contrasts can be achieved on the printed material web.

Printing and/or overcoating the material web favorably take/takes place in-line in the corrugated-board machine. It is advantageous if the material web is conveyed during its printing and/or overcoating.

It is advantageous if the material output device comprises at least one material web roller. The material-output device is favorably constituted as a splicing device, so that the material web is endless. The corrugated-board machine preferably comprises further material-output devices for outputting further material webs for the formation of the corrugated board.

The inkjet printing device is particularly capable of emitting water-based color or respectively ink for the printing of the material web. It is advantageous if the inkjet printing device is constituted to produce at least one water-based color imprint on the material web. The ink system is preferably based on pure-thermal hardening or a hybrid method, wherein, in this sense, a UV hardening is implemented after a thermal pre-treatment.

The at least one imprint comprises, for example, at least one letter, number, another character, a graphic and/or a photograph. The at least one imprint favorably covers one side of the material web at least in regions, which is visible from the outside in the finished corrugated board or respectively corrugated-board web.

It is advantageous if the overcoating arrangement is capable of applying at least one preferably several overcoat/s on the printed material web.

The printed and overcoated material web is a component of a corrugated-board web, which favorably comprises in its entirety at least two, preferably three, five or seven material webs. The printed and overcoated material web preferably forms an outer laminated web in the finished corrugated-board web.

The terms "downstream", "upstream", "disposed downstream", "disposed upstream" or similar relate generally to the conveying direction of the respective web. This applies by analogy for similar terms.

The at least one overcoating layer applicable with the varnishing for substantially full-faced overcoating a printed side of the material web with at least one overcoating layer, wherein the varnishing unit preferably comprises at least one overcoat-application roller for applying the at least one overcoating layer on the printed side of the material web, is favorably formed by matt varnish. The at least one overcoating layer allows an extremely good and simple further processing of the material web or respectively corrugated-web board. In particular, the at least one overcoating layer can be printed at least in one color. Furthermore, the at least one overcoating layer offers extremely good adhesive properties in order to guarantee bondability of components of corrugated-board sheets, especially flaps. The at least one overcoating layer can be manufactured in a cost-favorable manner. It favorably has a substantially uniform thickness.

An application width of the varnishing unit is favorably adaptable. It is advantageous if the varnish quantity to be applied is also adaptable. This can be achieved, especially with the embodiments of the dosage elements for dosed application of the at least one overcoating layer onto the material web.

It is advantageous if the varnishing unit comprises at least one overcoat-application roller for applying the at least one overcoating layer onto the printed side of the material web and favorably at least one dosage element for the dosed application of the at least one overcoating layer to the material web. This embodiment allows an extremely economical and uniform application of the at least one overcoating layer to the printed material web.

The at least one overcoat application roller is favorably constituted to be smooth. It is advantageous if at least one overcoat-dosage roller is associated with the at least one overcoat-application roller for the dosed application of the overcoat to the printed material web. This embodiment is particularly suitable for high-viscosity varnishes. For low-viscosity varnishes, varnishing units which can comprise at least one anilox roller or at least one other dosage element, such as a chambered doctor blade, pressure chamber doctor blades and several varnish transfer rollers, rubber blankets or sleeve rollers are particularly suitable. The web to be varnished is preferably presented to the at least one overcoat-application roller in a defined manner, favorably looped around a rubber-coated roller. With the use of anilox rollers for the dosage of the overcoating layer, for economic reasons, these anilox rollers can, at the same time, have the function of the overcoat application roller, that is, transferring the overcoat directly to the paper. It is advantageous if the preferably rubber-coated roller for the presentation of the material web to the application roller is displaceable, in order to stop and also to restart applying the overcoating layer to the running material web rapidly, as required.

The embodiment in which the varnishing unit comprises a varnish-application control device, which controls an application of the at least one overcoating layer onto the printed side of the material web via a detected moisture and/or layer thickness of the at least one overcoating layer leads to an overcoating which is particularly visually attractive and can also be produced in an extremely economical manner. In order to detect the moisture and/or the layer thickness of the at least one overcoating layer, at least one detection device, such as a sensor unit or camera unit, is favorably associated with the printed material web provided with at least one overcoating layer.

The inkjet-varnishing device for inkjet-varnishing the printed material web in regions with at least one inkjet-varnish region, wherein the at least one inkjet-varnish region is preferably smaller in its area on the printed material web than at least one overcoating layer, is favorably capable of applying gloss ink in regions to the printed material web for the formation of the at least one inkjet-varnish region. The gloss ink is preferably transparent. It favorably contains latex or is based on latex or respectively aqueous polymer dispersions and favorably has a lower viscosity than the matt varnish. The at least one inkjet-varnish region is characterized, in particular, by a higher degree of gloss by comparison with the at least one overcoating layer. The highlight values in the at least one inkjet-varnish region are present between 50 to 80 with a 60° measurement geometry in accordance with ASTM D 523. As a result of the at least one overcoating layer, less, especially substantially less, gloss ink is necessary with reference to volume, in order to achieve these high-ligh values, than if the gloss ink is applied to a printed region without overcoating layer. Because of the high price of gloss ink, the method is therefore very economical. The at least one inkjet-varnish region is favorably smaller, preferably substantially smaller in its area on the printed material web than the at least one overcoating layer. It is advantageous if at least one region on the overcoated printed material web remains free from the at least one inkjet-varnish region for subsequent glued connection to at least one material web or respectively corrugated-board component. Applying the gloss ink for the formation of the at least one inkjet-varnish region on the at least one overcoating layer ideally takes place in the wet-in-wet process, which is wherein absolutely no, or at least no complete, drying of the at least one overcoating layer takes place, and the distance up to applying the gloss ink is favorably short, preferably shorter than 10 m, ideally shorter than 5 m. In order to guarantee a short flow time and sharp-edged gloss contours of the inkjet varnish, the distance from applying the inkjet varnish to the drying is short, especially shorter than 10 m, especially shorter than 5 m.

It is expedient if the at least one inkjet region covers the at least one imprint at least in regions. Accordingly, an increased gloss effect can be given to the at least one imprint at least in regions, which is visually attractive and interesting. Such a corrugated board creates a very high-quality effect. The punctual degree of gloss is also particularly readily adjustable. In particular, partial spot varnishing, so-called drip-off effects, or gloss gradients can also be readily realized. Gloss contours are possible, for example, independently of structures of the at least one imprint.

The inkjet-varnishing control device for the position control of the at least one inkjet-varnish region on the printed material web, wherein the positioning control preferably takes place on the basis of markings of the printed material web, favorably allows an alignment of the at least one inkjet-varnish region according to the at least one imprint. In particular, the at least one imprint and the at least one inkjet-varnish region are arranged one above the other or respectively cover one another. In particular, a different alignment is also possible. The material web to be overcoated favorably comprises markings for the position control of the at least one inkjet region. The markings are printed, for example, onto the material web and/or formed by cuts. In a favorable manner, these markings are at the same time used for cutting the format in a transverse cutting device.

It is advantageous if a flash unit with varnish monitoring for the adjustment of an overprinting accuracy of the at least one inkjet-varnish region with reference to the at least one imprint and/or a gloss-measuring unit for measuring the gloss of the overcoated corrugated-board web is/are provided downstream of the inkjet-varnishing device. The varnish monitoring comprises, for example, at least one varnish-monitoring camera, while the gloss-measuring unit comprises, for example, at least one gloss-measuring sensor. The varnish monitoring and/or the gloss-measuring unit are favorably traversing systems.

In one embodiment, a marking-reading device is present for the reading of markings arranged on the printed material web, wherein the inkjet-varnishing control device receives marking-position signals from the marking-reading device. This is preferably a contrast sensor. It is advantageous if the marking-reading device is arranged upstream or downstream of the inkjet-varnishing device. For example, scalings on the varnish subject for the purpose of dimensional equality and/or position correction of the varnish image can be implemented using the markings. In particular, the spacing distance from successive markings is used in order to detect the dimension of the at least one imprint.

It is advantageous if the inkjet-varnishing control device communicates scaling/size values to the inkjet-varnishing device for matching the at least one inkjet-varnish region to the at least one imprint. In particular, a size of the at least one inkjet-varnish region can be matched to the at least one imprint. For this purpose, the inkjet-varnishing control device favorably receives corresponding information which is based on the distance measurements of markings on the material web, especially longitudinally and/or transversely to the material web. These measurements can be implemented, for example, by a sensor and/or camera unit. Favorably, these measurements are performed by means of an imprint check unit.

In one embodiment, the inkjet-varnishing device is disposed downstream of the varnishing unit in conveying direction of the material web. The at least one overcoating layer is favorably arranged between the one inkjet-varnish region and the printed material web.

The embodiment in which a control in a flow time of the at least one imprint and/or of the overcoating leads to corrugated board which is of particularly high quality.

The pre-drying (pinning) for controlling the flow time favorably takes place through at least one corresponding pinning device.

It is expedient if a pre-coating application device for applying a pre-coating to the material web to be printed is arranged upstream of the inkjet printing device, wherein a pre-coating drying device for the drying of the pre-coated material web is preferably arranged downstream of the pre-coating application device. This embodiment leads to a material web which can be printed and/or overcoated particularly readily. Such a corrugated-board is visually extremely attractive.

The same applies substantially to a corrugated-board machine with a corona pre-treatment device for the pre-treatment of the material web to be printed, which is arranged upstream of the inkjet printing device. Surface energy of the material web can be controlled by means of corona pre-treatment and/or pre-tempering.

It is expedient if a pre-heating device for the pre-heating of the printed and overcoated material web and at least one further material web, especially at least one corrugated-board web is arranged downstream of the overcoat varnishing arrangement. The pre-heating device favorably comprises pre-heating rollers which are disposed in contact with the material webs to be connected in order to heat the same.

A gluing unit for applying glue to at least one further material web, especially corrugated-board web to be connected to the printed and overcoated material web is disposed downstream of the overcoating arrangement.

It is advantageous if a material web pre-heating device is arranged upstream of the overcoating arrangement for pre-heating the material web. Favorably, a material web (pre-) drying device is arranged downstream of the varnishing unit, preferably between the varnishing unit and the inkjet-varnishing device for (pre-) drying the varnished material web.

In the following, preferred embodiments of the invention are described by way of example with reference to the attached drawings.

DESCRIPTION OF THE PREFERRED EMBODIMENTS

Figure 1:
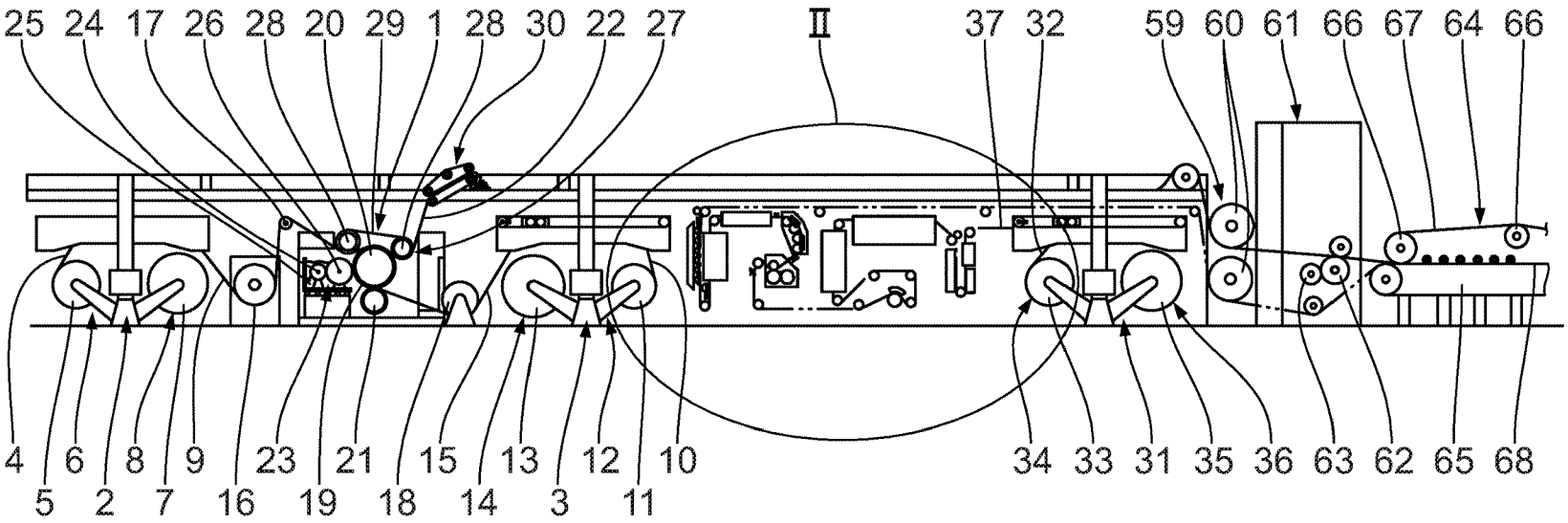
FIG. 1 shows a schematic view of a first upstream part of a corrugated-board machine according to the invention.
Figure 2:
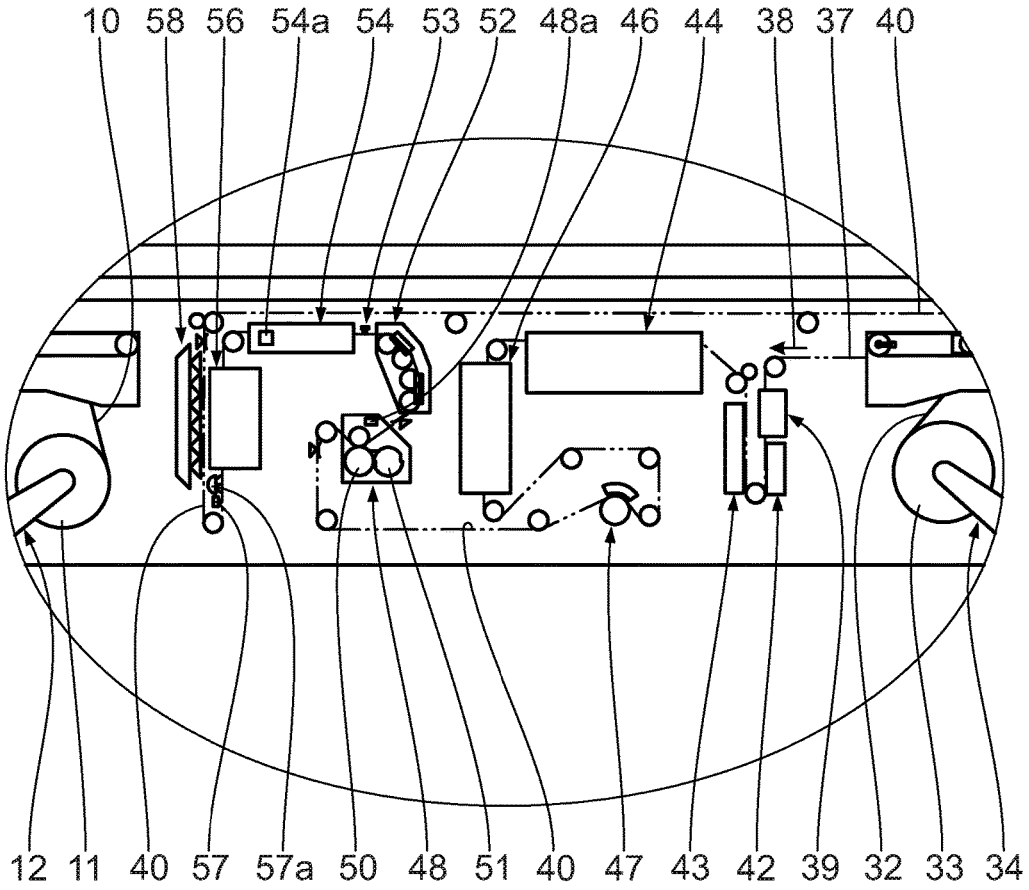
FIG. 2 shows an enlarged view of the region marked in FIG. 1, which shows, in particular, the inkjet printing device and the overcoating arrangement.
Figure 3:
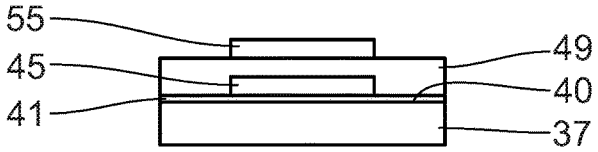
FIG. 3 shows a simplified section which visualizes the printed and overcoated material web.

Initially, with reference to FIG. 1, a corrugated-board machine comprises an arrangement 1 for manufacturing an endless corrugated-board web laminated on one side.

A first splicing device 2 and a second splicing device 3 are arranged upstream of the arrangement 1 for manufacturing an endless corrugated-board web laminated on one side.

The first splicing device 2 comprises a first unrolling unit 6 for the unrolling of an open-ended first material web 4 from a first material-web roller 5 and a second unrolling unit 8 for the unrolling of an open-ended second material web from a second material-web roller 7. The open-ended first material web 4 and second material web are connected to one another in order to provide an endless first material web 9 by means of a connecting and cutting unit of the first splicing device 2 which is not illustrated.

The second splicing device 3 is constituted to correspond to the first splicing device 2. This comprises a third unrolling unit 12 for the unrolling of an open-ended third material web 10 from a third material-web roller 11 and a fourth unrolling unit 14 for the unrolling of an open-ended second material web from a fourth material-web roller 13. The open-ended third material web 10 and fourth material web are connected to one another in order to provide an endless second material web 15 by means of a connecting and cutting unit of the second splicing device 3 which is not illustrated.

The endless first material web 9 is supplied via a heating roller 16 and a first deflection roller 17 to the arrangement 1 for manufacturing an endless corrugated-board web laminated on one side, while the endless second material web 15 is supplied via a second deflection roller 18 to the arrangement 1 for manufacturing an endless corrugated-board web laminated on one side.

The arrangement 1 for manufacturing an endless corrugated-board web laminated on one side comprises, for the production of an endless corrugated web 19 comprising a corrugation from the endless second material web 15, a first corrugating roller 20 mounted in a rotatable manner and a second corrugating roller 21 mounted in a rotatable manner. The corrugating rollers 20, 21 form a roller gap for the passage and corrugation of the endless second material web 15, wherein axes of rotation of the two corrugating rollers 20, 21 extend parallel to one another. Together, the corrugating rollers 20, 21 form a corrugating unit.

For the connection of the endless corrugated web 19 to the first endless material web 9 to form an endless corrugated-board web 22 laminated on one side, the arrangement 1 for manufacturing an endless corrugated-board web laminated on one side comprises a glue-application unit 23, which comprises a glue-dosage roller 24, a glue container 25 and a glue-application roller 26. For the passage and gluing of the endless corrugated web 19, the glue-application roller 26 forms a gluing gap with the first corrugating roller 20. The glue disposed in the glue container 25 is applied via the glue-application roller 26 to tips of the corrugation of the endless corrugated web 19. The glue-dosage roller 24 is disposed in contact with the glue-application roller 26 and serves for the formation of a uniform glue layer on the glue application roller 26.

The endless first material web 9 is then fitted together with the endless corrugated web 19 provided with glue from the glue container 25 in the arrangement 1 for manufacturing an endless corrugated-board web 22 laminated on one side, thereby forming a corrugated-board web laminated on one side.

For the pressing of the endless first material web 9 against the endless corrugated web 19 provided with glue, which, in turn, is in contact in regions with the first corrugating roller 20, the arrangement 1 for manufacturing an endless corrugated-board web has a pressing device 27. The pressing device 27 is favorably constituted as a pressing-belt module and is arranged above the first corrugating roller 20. The pressing module 27 has two deflection rollers 28 and an endless pressing belt 29, which is guided around the deflection rollers 28. The first corrugating roller 20 engages in a space present between the deflection rollers 28 in regions, so that the pressing belt 29 is deflected by the first corrugating roller 20. The pressing belt 29 presses against the endless first material web 9, which is pressed in turn against the endless corrugated web 19 provided with glue, in contact with the first corrugating roller 20.

For the intermediate storage and buffering of the endless corrugated-board web 22 laminated on one side, this is supplied to a storage unit 30, where the latter forms loops or bows.

Furthermore, the corrugated-board machine as a third splicing device 31, which is constituted corresponding to the first or respectively second splicing device 2, 3. The third splicing device 31 comprises a fifth unrolling unit 34 for the unrolling of an open-ended fifth material web 32 from a fifth material-web roller 33, and a sixth unrolling unit 36 for the unrolling of an open-ended sixth material web from a sixth material-web roller 35. The open-ended fifth material web 32 and sixth material web are connected to one another in order to provide an endless third material web 37 by means of a connecting and cutting unit of the third splicing device 31, which is not illustrated. The endless third material web 37 forms an outer laminated web on the finished corrugated-board web to be produced.

The endless third material web 37 is conveyed downstream to the third splicing device 31 in a conveying direction 38.

Downstream of the third splicing device 31, a pre-coating application device 39 is associated with the endless third material web 37, which applies a two-dimensional pre-coating 41 onto the outer side 40 of the endless third material web 37. In particular, the two-dimensional pre-coating 41 substantially covers the endless third material web 37 over the full surface of its outer side 40.

Downstream of the pre-coating application device 39, a pre-coating drying device 42, which dries the endless third material web 37 provided on the outside with the pre-coating 41 or respectively the pre-coating 41, is associated with the endless third material web 37.

Downstream of the pre-coating drying device 42, a cleaning device 43, which cleans the endless third material web 37, which carries the dried pre-coating 41, at least on the outside, is associated with the endless third material web 37.

Downstream of the cleaning device 43, an inkjet printing device 44, which imprints at least one imprint 45 onto the endless third material web 37 or respectively onto the dried pre-coating 41, is associated with the endless third material web 37. The pre-coating 41 is accordingly disposed between the at least one imprint 45 and the third material web 37. The at least one imprint 45 is favorably a water-based color imprint. In its area, it is favorably smaller than the pre-coating 41.

Downstream of the inkjet printing device 44, an inkjet print drying device 46 which dries the printed endless third material web 37 or respectively its at least one imprint 45, is associated with the endless third material web 37.

Downstream of the inkjet print drying device 46, an imprint checking unit 47 which checks the at least one imprint 45 printed onto the endless third material web 37, is associated with the endless third material web 37.

Downstream of the imprint checking unit 47, a varnishing unit 48 for the full-surface application of at least one transparent overcoating layer 49 to the outside of the endless third material web 37 is associated with the endless third material web 37. The at least one imprint 45 is accordingly disposed between the at least one overcoating layer 49 and the pre-coating 41. The at least one overcoating layer 49 covers the full surface of the at least one imprint 45 and is in direct contact with the latter. Laterally alongside the at least one imprint 45, the at least one overcoating layer 49 is in direct contact with the pre-coating 41. The at least one overcoating layer 49 is formed by matt varnish, which is based on water and also designated as water varnish or respectively dispersion varnish.

The varnishing unit 48 in the exemplary embodiment described comprises an overcoat-application roller 50, which faces towards the outer side 40 of the endless third material web 37. The varnishing unit 48 further comprises a standing overcoat dosage roller 51, which is preferably constituted as "comma bar" or respectively comma-bar, and is presented to the overcoat-application roller 50 at a precise angle in order to ensure a uniform overcoat film on the latter. A fluid bath or respectively varnish bath is disposed, in one illustrated variant, on an upper side between the overcoat-application roller 50 and the overcoat-dosage roller 51 in a space closed off at the bottom apart from a small gap. The varnish transfer from the application roller 50 and the material web 37 takes place here, for example, in so-called "synchronization". Other embodiments of the dosage method are possible as an alternative.

Downstream of the varnishing unit 48, a material-web inspection device 52, which inspects the endless third material web 37 for faults especially on its outer side 40, is associated with the endless third material web 37. This material-web inspection device 52 checks especially the flatness of the third material web 37. With regard to details and function of the material-web inspection device 52, reference is made, for example, to WO 2014/128115 A1.

Downstream of the material-web inspection device 52, a marking-reading device 53, which is, in particular, capable of reading or respectively detecting external markings 72, 74 (FIG. 5) of the endless third material web 37, is associated with the endless third material web 37. The marking-reading device 53 favorably operates in a contactless manner.

Downstream of the marking-reading device 53, an inkjet-varnishing device 54, which applies at least one spatially limited inkjet-varnish region 55 to the outside of the endless third material web 37, is associated with the endless third material web 37. The at least one overcoating layer 49 is accordingly disposed between the at least one inkjet-varnish region 55 and the pre-coating 41. The at least one inkjet-varnish region 55 favorably covers the at least one imprint 45 at least in regions, for example, along its contours or over the full surface.

This arrangement of the at least one inkjet-varnish region 55 can favorably be achieved by the marking-reading device 53. The markings 72, 74 detected by the marking-reading device 53 provide information about the arrangement of the at least one imprint 45 and/or the position of the at least one inkjet varnish region 55 to be produced. The inkjet-varnishing device 54 has a corresponding inkjet-varnishing control device 54*a* for this purpose.

Downstream of the inkjet-varnishing device 54, an inkjet-varnish drying device 56 for drying the endless third material web 37 or respectively the at least one inkjet-varnish region 55, is associated with the endless third material web 37. The drying is implemented here thermally by infrared radiation and/or by hot air. A combination of both heat sources is particularly advantageous.

Downstream of the inkjet varnish drying device 56, a flash unit 57 and gloss-measuring unit 57*a*, which measures an outside gloss of the endless third material web 37 or respectively of the at least one inkjet-varnish region 55, is associated with the endless third material web 37. The flash unit 57 allows control of an overprinting accuracy through directed reflection of the inkjet varnish by reading in markings 72, 74. The markings 72, 74 preferably comprise at least one dash, circle, semicircle, registration marks or at least one similar, simple geometric shape. The corrections required on this basis, can be implemented by the inkjet-varnishing device 54, which then receives corresponding signals.

Downstream of the flash unit 57 and gloss-measuring unit 57*a*, a moistening unit 58, which supplies water, favorably in the form of a steam spray, onto the endless third material web 37, opposite to the outer side 40, is associated with the endless third material web 37. A flat position and a homogenous moisture profile of the third material web 37 can be guaranteed as a result. It is advantageous if the moistening unit 58 comprises a zone circuit and can be controlled by the measured value of a downstream, traversing moisture sensor.

A pre-heating device 59, which comprises two pre-heating rollers 60 arranged one above the other is disposed downstream of the storage unit 30 and the moistening unit 58. The corrugated-board web 22 laminated on one side and the endless third printed, dried and overcoated material web 37, which both partially surround the respective pre-heating roller 60, are supplied to the pre-heating device 59. The endless third material web 37 runs in the pre-heating device 59 below the corrugated-board web 22 laminated on one side, wherein the outer side 40 of the endless third material web 37 faces downwards there or respectively faces away from the corrugated-board web 22 laminated on one side.

A gluing unit 61 with a gluing roller 62, which is partially immersed in a glue bath, is arranged downstream of the pre-heating device 59. The corrugated-board web 22 laminated on one side is disposed in contact with the gluing roller 62 and is accordingly provided with glue from the glue bath. A dosage roller 63 is in contact with the periphery of the gluing roller 62 in order to form a uniform glue film on the gluing roller 62. The endless third material web 37 runs in the gluing unit 61 below the corrugated-board web 22 laminated on one side, wherein the outer side of the endless third material web 37 faces downwards there or respectively faces away from the corrugated-board web 22 laminated on one side. A hot-pressing device 64 which comprises a horizontally extending heated table 65 with heating elements is arranged downstream of the gluing unit 61. A pressing belt 67 guided via guide rollers 66 is arranged adjacent to the heated table 65. Between the pressing belt 67 and the heated table 65, a pressing gap is formed, through which the glued corrugated-board web 22 laminated on one side and the endless third, printed and overcoated material web 37 are guided. The endless third material web 37 runs in the hot-pressing device 64 below the corrugated-board web 22 laminated on one side, wherein the outer side 40 of the endless third material web 37 faces downwards there or respectively faces away from the corrugated-board web 22 laminated on one side.

An endless corrugated-board web 68 laminated on both sides, which is printed on the outer side, is present downstream of the hot pressing device 64. According to one alternative embodiment, more than three material webs are present.

A longitudinal cutting/creasing device (not illustrated) for the longitudinal cutting and creasing of the corrugated-board web 68, a transverse cutting device for the transverse cutting of the corrugated-board web 68, distributing guide (not illustrated) for subdividing the corrugated-board sub-webs produced from the corrugated-board web 68 into different levels, transverse cutting devices (not illustrated) for the transverse cutting of the corrugated-board sub-webs into corrugated-board sheets and stacking devices (not illustrated) for the stacking of the corrugated-board sheets are arranged downstream of the hot-pressing device 64.

The at least one imprint 45 produced is visually extremely attractive. It is characterized, in particular, by the impression of an extremely high-quality gloss. Furthermore, this is extremely abrasion-resistant, because it is protected.

Figure 4:
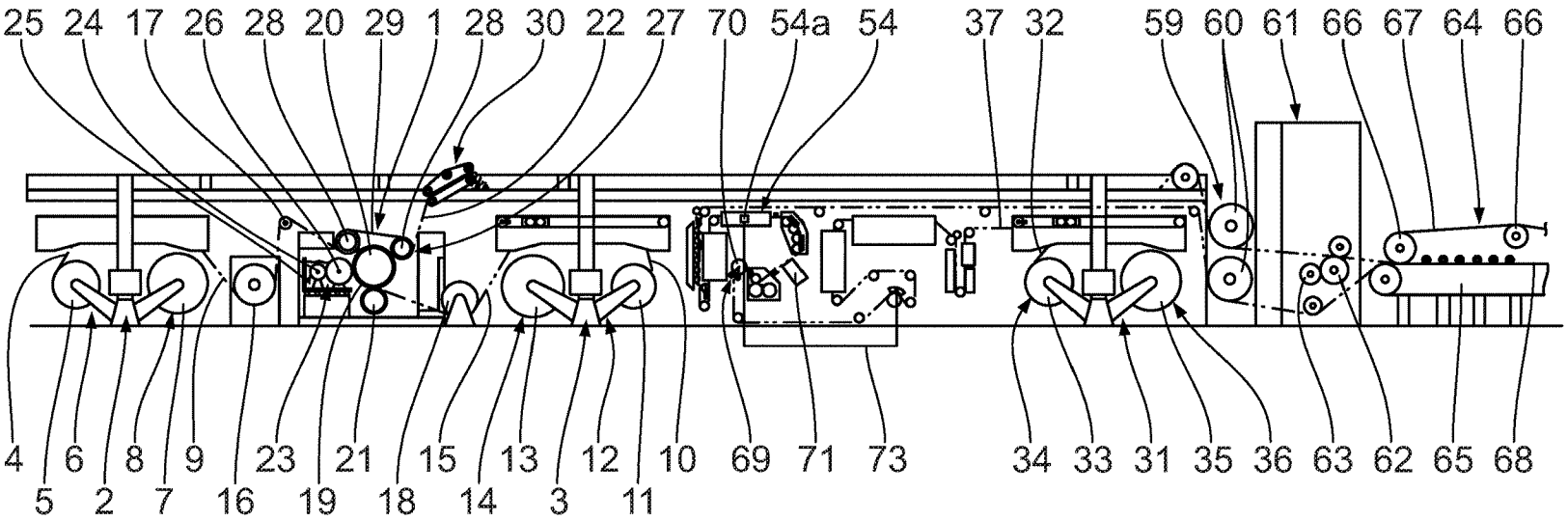
FIG. 4 shows a diagrammatic view of a first upstream part of a corrugated-board machine according to the invention according to a second embodiment.
Figure 5:
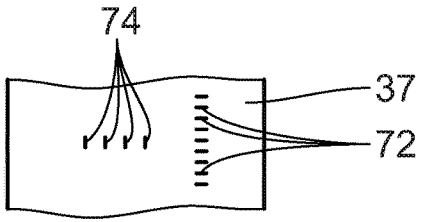
FIG. 5 shows a plan view of a section of a material web.

The following is a description, with reference to FIGS. 4, 5, of a second embodiment. Contrary to the previous embodiment, to the description of which is made reference explicitly, a material web pre-heating device 69 is arranged upstream of the overcoating arrangement, said material web pre-heating device 69 being in particular arranged upstream of the varnishing unit 48 and, preferably, adjacent thereto. The material web pre-heating device 69 favorably comprises a material web pre-heating roller 70 about which the endless third material web 37 is guided. It is expedient if a wrap angle of the endless third material web 37 about the material web pre-heating roller 70 is adjustable to adapt the pre-heating of the endless third material web 37.

Downstream of the varnishing unit 48, a material web pre-drying unit 71 is provided, said material web pre-drying unit 71 being associated to the endless third material web 37, to expose the endless third material web 37 to a pre-drying procedure after the application of the at least one transparent overcoating layer 49. The material web pre-drying device 71 is favorably arranged upstream of the material web inspection device 52 to ensure that the endless third material web 37 has dried at least partly upon reaching the material web inspection device 52.

Favorably, the marking-reading device 47 detects the cross and longitudinal markings 72, 74 applied to the endless third material web 37. The corresponding distance information of the cross markings 72 relative to each other and of the longitudinal markings 74 relative to each other is transmitted, via a signal line 73, to the inkjet-varnishing control device 54*a* to adapt the size of the at least one inkjet region to the at least one imprint. Alternatively or in addition thereto, cross cutting markings on the endless third material web 37 and their distance to each other are detected. Alternatively, the size of the at least one imprint is detected and compared with an artwork to adapt the size of the at least one inkjet region to the at least one imprint. As a function thereof, the inkjet varnishing device 54 is actuated accordingly, taking into consideration the size adjustment of the inkjet varnishing device 54.

It is conceivable to combine the embodiments with each other.

What is claimed is:

1. A corrugated-board machine for manufacturing corrugated board, comprising a) a material-web output device for outputting a material web, b) an inkjet printing device disposed downstream of the material-web output device for printing at least one imprint on the material web, and c) an overcoating arrangement, disposed downstream of the inkjet printing device, for overcoating the printed material web at least in regions, the overcoating arrangement comprising a varnishing unit for substantially full-faced overcoating a printed side of the material web with at least one overcoating layer, the varnishing unit comprising at least one overcoat-application roller for applying the at least one overcoating layer on the printed side of the material web, the overcoating arrangement further comprises an inkjet-varnishing device for inkjet-varnishing the printed material web in regions with at least one inkjet-varnish region, the at least one inkjet-varnish region covers the at least one imprint at least in regions in order to increase its gloss effect at least in regions;

an inkjet-varnishing control device for position control of the at least one inkjet-varnish region on the printed material web, the positioning control taking place on the basis of markings of the printed material web, the inkjet-varnishing control device communicating scaling/size values to the inkjet-varnishing device for matching the at least one inkjet-varnish region to the at least one imprint, the inkjet-varnishing control device being configured to match a size of the at least one inkjet-varnish region to the at least one imprint by receiving corresponding information which is based on distance measurements of the markings on the material web.

2. A corrugated-board machine according to claim 1, wherein the varnishing unit comprises at least one dosage element for dosed application of the at least one overcoating layer onto the material web.

3. A corrugated-board machine according to claim 1, wherein the varnishing unit comprises a varnish-application control device, which controls an application of the at least one overcoating layer onto the printed side of the material web via at least one of the group comprising a detected moisture and a layer thickness of the at least one overcoating layer.

4. A corrugated-board machine according to claim 1, wherein the at least one inkjet-varnish region is smaller in its area on the printed material web than at least one overcoating layer.

5. A corrugated-board machine according to claim 1, wherein the at least one inkjet-varnish region is characterized by a higher degree of gloss by comparison with the at least one overcoating layer.

6. A corrugated-board machine according to claim 1, comprising a marking-reading device for the reading of markings arranged on the printed material web, wherein the inkjet-varnishing control device receives marking-position signals from the marking-reading device.

7. A corrugated-board machine according to claim 1, wherein a matching of the at least one inkjet-varnish region to the at least one imprint takes place.

8. A corrugated-board machine according to claim 1, wherein the inkjet-varnishing device is disposed downstream of the varnishing unit in conveying direction of the material web.

9. A corrugated-board machine according to claim 1, comprising a control in a flow time of at least one of the group comprising the at least one imprint and of the overcoating.

10. A corrugated-board machine according to claim 9, wherein the flow time is controllable through pre-drying.

11. A corrugated-board machine according to claim 1, wherein an inkjet print drying device for drying the printed material web is disposed downstream of the inkjet printing device.

12. A corrugated-board machine according to claim 1, wherein a hot-pressing device for connecting the printed and overcoated material web to at least one further material web is disposed downstream of the overcoating arrangement.

13. A corrugated-board machine according to claim 12, wherein the at least one further material web is at least one corrugated-board web.

14. A corrugated-board machine according to claim 12, wherein at least one moistening unit is arranged between the overcoating arrangement and the hot-pressing device.

15. A method for manufacturing corrugated board, comprising the following steps:

output of a material web by means of a material-web output device, imprinting of at least one imprint onto the material web output by the material-web output device by means of an inkjet printing device, and substantially full-faced overcoating a printed side of the printed material web at least in regions with at least one overcoating layer by means of an overcoating arrangement, said overcoating apply the overcoating layer with an overcoat-application roller;

inkjet-varnishing the printed material web with an inkjet-varnishing device in least one inkjet-varnish region, the inkjet-varnishing being performed to cover the at least one imprint at least in regions with the at least one inkjet-varnish region in order to increase a gloss effect at least in regions;

position controlling inkjet-varnishing of the at least one inkjet-varnish region on the printed material web, the position control taking place on the basis of markings of the printed material web;

communicating scaling/size values to the inkjet-varnishing device for matching the at least one inkjet-varnish region to the at least one imprint;

matching a size of the at least one inkjet-varnish region to the at least one imprint by receiving corresponding information which is based on distance measurements of the markings on the material web.

16. A corrugated-board machine for manufacturing corrugated board, the machine comprising:

a web output device for providing a material web;

an inkjet printing device receiving the material web from said web output device and printing an imprint on a side of the material web;

a varnishing unit disposed downstream of said inkjet printing device and receiving the material web from said inkjet printing device, said varnishing unit overcoating a substantially full-faced varnish overcoating layer on the side of the material web, said varnishing unit comprising an overcoat-application roller for applying the varnish overcoating layer;

an inkjet-varnishing device disposed downstream of said varnishing unit and receiving the material web from said varnishing unit, said inkjet-varnishing device inkjet-varnishing the material web on top of the varnish overcoating layer with at least one inkjet-varnish region;

an inkjet-varnishing control device communicating scaling/size values to the inkjet-varnishing device for matching the at least one inkjet-varnish region to the at least one imprint, the inkjet-varnishing control device being configured to match a size of the at least one inkjet-varnish region to the at least one imprint by receiving corresponding information which is based on distance measurements of markings on the material web.

17. A machine in accordance with claim 16, wherein:

the inkjet varnish region is smaller in area than the overcoating layer;

the varnish overcoating and the inkjet varnish region have different degrees of gloss;

said varnishing unit applies the overcoating layer on top of the imprint.

18. A corrugated-board machine for manufacturing corrugated board, the machine comprising:

a material-web output device for outputting a material web, an inkjet printing device disposed downstream of the material-web output device for printing at least one imprint on the material web, and an overcoating arrangement, disposed downstream of the inkjet printing device, for overcoating the printed material web at least in regions, the overcoating arrangement comprising a varnishing unit for substantially full-faced overcoating a printed side of the material web with at least one overcoating layer, the varnishing unit comprising at least one overcoat-application roller for applying the at least one overcoating layer on the printed side of the material web, the overcoating arrangement further comprises an inkjet-varnishing device for inkjet-varnishing the printed material web in regions with at least one inkj et-varnish region, the at least one inkjet-varnish region covers the at least one imprint at least in regions in order to increase its gloss effect at least in regions;

an inkjet-varnishing control device for position control of the at least one inkjet-varnish region on the printed material web, the positioning control taking place on the basis of markings of the printed material web;

an inkjet-varnish drying device arranged shorter than 10 meters from the inkjet-varnishing device, whereby drying guarantees a short flow time and sharp-edged gloss contours of the inkjet varnish.

* * * * *